US008296985B2

(12) United States Patent
Krutil et al.

(10) Patent No.: US 8,296,985 B2
(45) Date of Patent: Oct. 30, 2012

(54) FIREARM WITH A TILTING BARREL

(75) Inventors: Josef Krutil, Zruc nad Sazavou (CZ); Vladimir Simek, Lostice (CZ)

(73) Assignee: Ceska Zbrojovka A.S. (CZ)

( * ) Notice: Subject to any disclaimer, the term of this patent is extended or adjusted under 35 U.S.C. 154(b) by 0 days.

(21) Appl. No.: 13/393,441

(22) PCT Filed: Sep. 9, 2010

(86) PCT No.: PCT/CZ2010/000100

§ 371 (c)(1),
(2), (4) Date: Feb. 29, 2012

(87) PCT Pub. No.: WO2011/032524

PCT Pub. Date: Mar. 24, 2011

(65) Prior Publication Data

US 2012/0159829 A1 Jun. 28, 2012

(30) Foreign Application Priority Data

Sep. 15, 2009 (CZ) ..... 2009-606

(51) Int. Cl.
*F41A 9/45* (2006.01)

(52) U.S. Cl. ..... 42/40; 42/105

(58) Field of Classification Search ..... 42/40, 12, 42/8, 13, 26, 28, 30–32, 2, 27, 105, 75.04, 42/75.02, 77

See application file for complete search history.

(56) References Cited

U.S. PATENT DOCUMENTS

| | | | | | |
|---|---|---|---|---|---|
| 11,157 | A * | 6/1854 | Greene | 42/13 |
| 43,259 | A * | 6/1864 | Perry | 42/12 |
| 193,906 | A * | 8/1877 | Wood | 42/12 |
| 1,476,125 | A * | 12/1923 | Wesson et al. | 42/12 |
| 3,568,350 | A * | 3/1971 | Silsby | 42/75.01 |
| 3,641,691 | A * | 2/1972 | Ellis et al. | 42/105 |
| 4,614,051 | A | 9/1986 | Thacker | |
| 5,617,665 | A * | 4/1997 | Hoenig | 42/8 |
| 6,481,145 | B2 * | 11/2002 | Weichert et al. | 42/105 |
| 7,487,612 | B2 * | 2/2009 | Macaluso | 42/10 |
| 7,661,348 | B2 | 2/2010 | Murello | |
| 2007/0068057 | A1 | 3/2007 | Macaluso | |
| 2007/0074437 | A1 | 4/2007 | Compton et al. | |

FOREIGN PATENT DOCUMENTS

| | | | |
|---|---|---|---|
| CA | 2521935 | A1 | 3/2007 |
| DE | 102005019594 | A1 | 11/2006 |

* cited by examiner

*Primary Examiner* — Michael Carone
*Assistant Examiner* — Reginald Tillman, Jr.
(74) *Attorney, Agent, or Firm* — Hovey Williams LLP

(57) ABSTRACT

A firearm with a tilting barrel (1) with the possibility of setting a change of the tilting direction of the barrel (1) containing a breech block (5) for securing the barrel, the breach block containing on a part of its perimeter a locking surface (11) for securing the firearm against its tilting in the direction opposite the locking surface (11). The locking surface can be rotated around the longitudinal axis of the breech block (5) for setting the change of the tilting direction of the barrel (1).

9 Claims, 3 Drawing Sheets

FIREARM WITH A TILTING BARREL

This is a national stage application under 35 U.S.C. §371 of International Application PCT/CZ2010/000100 filed 9 Sep. 2010, which claims the benefit of Czech Republic application serial no. PV 2009-606 filed 15 Sep. 2009, the entire disclosures of which are incorporated herein by reference.

FIELD OF THE INVENTION

The invention deals with a firearm, e.g. a grenade launcher, with a tilting barrel.

BACKGROUND OF THE INVENTION

Firearms are known that have a barrel that can be tilted to a side, especially grenade launchers.

A disadvantage of most of these weapons is that the barrel can only be tilted to one side.

Weapons that offer the possibility of changing the barrel tilting direction require tools and at least disassembly of some parts of the weapon for the execution of such a change. This is e.g. the case of weapons sold under the AG-C/EGLM name made by Heckler-Koch, EAGLE by Colt Canada, etc.

In the case of the AG-C/EGLM weapon made by the Heckler-Koch company, the design of which is described in the patent no. DE 10 2005 019 594 A1, the change of the tilting side requires disassembly of the whole barrel. For this, certain time and tools or special instruments are necessary. Our invention eliminates this need as it allows one to change the tilting side without using any tools or special instruments. The EAGLE grenade launcher made by Colt Canada, described in the patent no. CA 2 521 935 A1, exhibits a similar problem.

The disadvantage of the necessity to use special tools is eliminated e.g. by the MK-13 grenade launcher in the SCAR project of the FNH USA company, but this firearm is opened by being extended forward in the shooting direction, which means that the barrel is removed from the gunner and that the loading is less comfortable as compared to tilting systems.

The goal of the invention is to eliminate the above mentioned disadvantages of firearms with a tilting barrel in the prior art while a weapon based on the invention will make it possible to change the tilting direction of the barrel easily without the necessity to use tools or special instrument or to disassemble a part of the barrel.

SUMMARY OF THE INVENTION

The above mentioned goals of the invention are achieved with a firearm with a tilting barrel in accordance with the invention containing a breech block for securing the barrel with the possibility of changing the barrel tilting direction, the principle of which is that the breech block contains on a part of its perimeter a locking surface for locking the barrel against its tilting in the direction opposite the locking surface, the locking surface being rotable around the longitudinal axis of the breech block for the purpose of setting the change of the tilting direction.

Such a firearm advantageously contains a forend that is firmly connected to the pawl and is removable in the shooting direction from the rear position, in which the pawl fits into a recess in the breech block and the firearm is thus in the locked condition, to the front position, in which the pawl is disengaged from the recess and the firearm is in the unlocked condition, and back against the shooting direction. The pawl in the position in which it fits into the recess may advantageously secure the locking surface in its angular position against its rotation around the longitudinal axis of the breech block at the same time.

The breech block advantageously contains a securing means used to secure the locking surface in its angular position against its rotation around the longitudinal axis of the breech block and if the weapon is to be readjusted to the other barrel tilting direction, to release the locking surface to enable its angular rotation to the required position and subsequent locking in this position. The pawl for locking the angular position of the locking surface may advantageously act as the above mentioned securing means.

BRIEF DESCRIPTION OF THE DRAWINGS

The invention will be explained in a more detailed way with the use of its example embodiment in connection with drawings where.

DESCRIPTION OF THE PREFERRED EMBODIMENT

Figure 1:
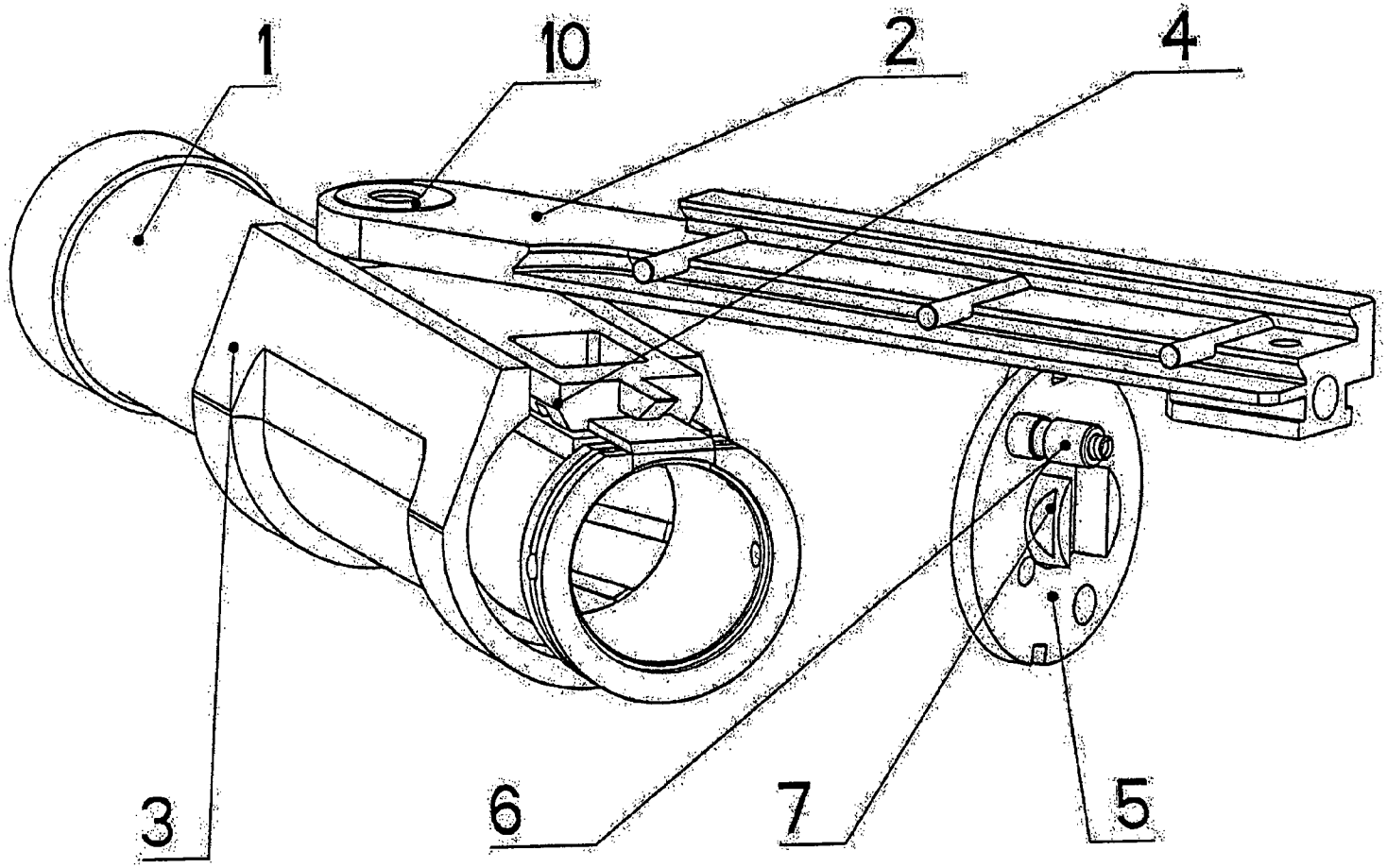
FIG. 1 is an isometric view which shows the embodiment of the invention with the firearm barrel after tilting to the left.
Figure 2:
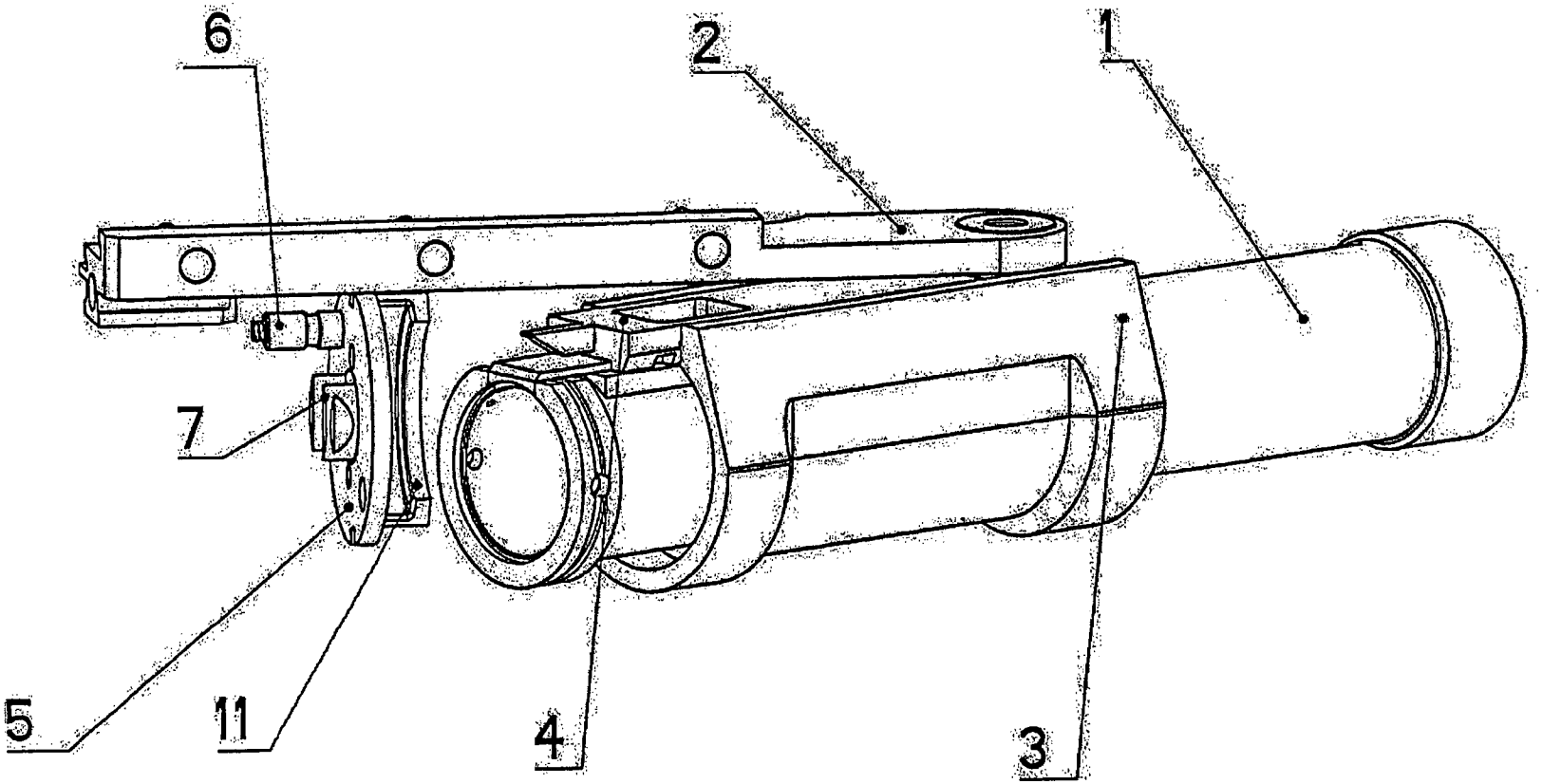
FIG. 2 is an isometric view showing the firearm of FIG. 1 after tilting of the barrel to the right.
Figure 3:
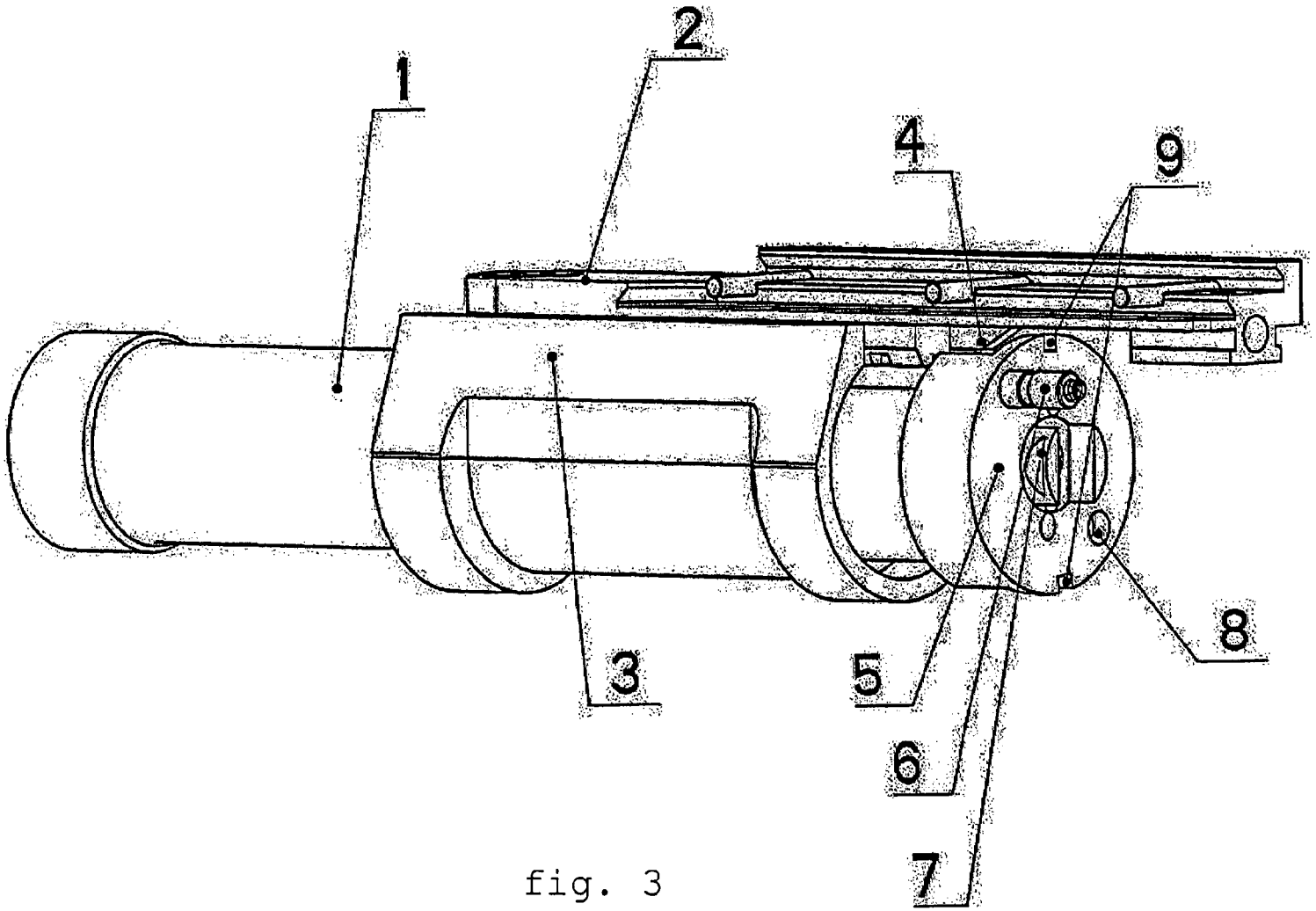
FIG. 3 is an isometric view showing the firearm in the unlocked, but unopened condition, which makes it possible to change the tilting direction of the barrel.

FIGS. 1 to 3 show a firearm design based on the invention. The firearm contains a breech block 5 designed for locking the firearm to the barrel 1. In the locked condition the breech block 5 is secured with a pawl 4 that fits into one of the recesses 9, which may be in a slot, thus making opening of the firearm impossible. In the locked condition the weapon is ready for shooting. Unlocking is done with the use of the fore-end 3, which is firmly connected to the pawl 4, by its movement forwards in the locking direction. After this movement the firearm is unlocked, but still closed. The opening is done by tilting of the barrel 1 to a side on a pivot 10 that is installed perpendicularly to the axis of the barrel 1. The axis of the pivot passes through the axis of the barrel 1.

The tilting direction of the barrel 1 is determined by the position of the breech block 5—if the locking surface 11 of the breech block 5 is on the rights, the barrel 1 is tilted to the left (see FIG. 1), and if the breech block 5 is removed in such a way that the locking surface 11 of the breech block 5 is on the left, the barrel 1 is tilted to the right (see FIG. 2).

The positions of the locking surface 11 of the breech block 5 can be changed simply and quickly directly by the user of the firearm, without the necessity to use any tools or special instruments. The position of the locking surface 11 of the breech block 5 is changed in the unlocked, but still closed condition of the firearm, i.e. in the condition when the fore-end 3, which is firmly connected to the pawl 4, has been moved forwards in the shooting direction. In this condition of the firearm the pawl 6 of the breech block 5 is removed backwards with regard to the shooting direction, ceasing to fix the position of the breech block 5. It can now turn on the nut 7 of the breech block 5, which is fixed with regard to the breech block 5.

FIG. 3 shows the firearm in the unlocked, but closed condition, the breech block 5 being in the position with the locking surface 11 on the left, so the barrel 1 would open to the right. Change of the opening direction of the barrel 1 is achieved by moving the pawl backwards, thereby unlocking the breech block 5, and by turning the breech block 5 until the pawl 6 fits into the opening 8. When the pawl 6 has fitted into the opening 8, the breech block 5 is again fixed with the pawl 6 and the barrel 1 can be opened to the left as the locking surface 11 of the breech block 5 has been removed to the right side of the firearm. Tilting of the barrel 1 to the right again is made possible in a similar way after releasing the pawl 6 by turning the breech block 5.

Industrial Applicability

Reversing the opening direction of the barrel of a firearm can especially be used in grenade launchers and other weapons with barrels that open to a side and the opening direction needs to be changed.

The invention claimed is:

1. A firearm comprising:

a tilting barrel; and a breech block for securing the barrel with the possibility of setting a change of a tilting direction of the barrel, wherein the breech block has a perimeter and contains on a part of its perimeter a locking surface for securing the firearm against tilting of the barrel in the direction opposite the locking surface, the locking surface being rotatable around a longitudinal axis of the breech block for setting a change of the tilting direction of the barrel.

2. The firearm according to claim 1, wherein the firearm contains a fore-end firmly connected to a pawl, the fore-end being movable in a shooting direction from a rear position, in which the pawl fits into a recess in the breech block and the firearm is thus in a locked condition, to a front position, in which the pawl is disengaged from the recess and the firearm is thus in an unlocked condition, and back against the shooting direction.

3. The firearm according to claim 2, wherein the pawl, when in the rear position in which it fits in the recess, at the same time secures the locking surface in its angular position against its rotation around the longitudinal axis of the breech block.

4. The firearm according to claim 1, wherein the breech block (5) contains a securing means for securing the locking surface in a first angular position against its rotation around the longitudinal axis of the breech block, and if the firearm is to be readjusted to another tilting direction of the barrel, for releasing the locking surface for its angular rotation to a second angular position and subsequent locking in this second angular position.

5. The firearm according to claim 4, wherein the securing means is a second pawl for securing the angular position of the locking surface.

6. The firearm according to claim 2, wherein the breech block contains a securing means for securing the locking surface in a first angular position against its rotation around the longitudinal axis of the breech block, and if the firearm is to be readjusted to another tilting direction of the barrel, for releasing the locking surface for its angular rotation to a second angular position and subsequent locking this second angular position.

7. The firearm according to claim 3, wherein the breech block contains a securing means for securing the locking surface in a first angular position against its rotation around the longitudinal axis of the breech block, and if the firearm is to be readjusted to another tilting direction of the barrel, for releasing the locking surface for its angular rotation to a second angular position and subsequent locking this second angular position.

8. The firearm according to claim 6, wherein the securing means is a second pawl for securing the angular position of the locking surface.

9. The firearm according to claim 7, wherein the securing means is a second pawl for securing the angular position of the locking surface.

* * * * *